US005292203A

United States Patent [19]

Whitman

[11] Patent Number: 5,292,203

[45] Date of Patent: Mar. 8, 1994

[54] SELF SEALING SUBSTANCE DISPENSER

[76] Inventor: Robert S. Whitman, 2714 Northview Rd., Philadelphia, Pa. 19152

[21] Appl. No.: 989,467

[22] Filed: Dec. 9, 1992

Related U.S. Application Data

[63] Continuation of Ser. No. 734,530, Jul. 23, 1991, abandoned.

[51] Int. Cl.[5] ..... B65D 51/00

[52] U.S. Cl. ..... 401/122; 220/229

[58] Field of Search ..... 220/229, 731, 734; 206/222, 567; 401/4, 122, 126, 180, 129; 132/73.5, 73, 75, 74.5

[56] References Cited

U.S. PATENT DOCUMENTS

| | | | |
|---|---|---|---|
| Re. 21,757 | 4/1941 | Deakers et al. | 401/180 X |
| 2,388,321 | 11/1945 | Gereke . | |
| 2,431,985 | 12/1947 | Bowman . | |
| 2,433,947 | 1/1948 | Gereke . | |
| 2,436,291 | 2/1948 | Daniel | 401/122 X |
| 2,580,169 | 12/1951 | Golden . | |
| 2,616,423 | 11/1952 | Kurkjian . | |
| 2,924,219 | 2/1960 | Wershaw . | |
| 3,567,085 | 3/1971 | Flores | 401/6 X |
| 3,938,686 | 2/1976 | Milligan et al. | 401/122 X |
| 4,282,891 | 8/1981 | Duceppe . | |
| 4,530,726 | 7/1985 | Montiel . | |
| 4,627,454 | 12/1986 | Dahn | 401/126 X |
| 4,747,842 | 5/1988 | Dietz . | |
| 4,960,339 | 10/1990 | Iizuka et al. | 401/4 X |
| 5,040,914 | 8/1991 | Fitjer | 401/129 X |
| 5,328,904 | 5/1992 | Iverson | 220/256 |

FOREIGN PATENT DOCUMENTS

| | | | |
|---|---|---|---|
| 783363 | 9/1957 | United Kingdom | 401/122 |

*Primary Examiner*—Danton D. DeMille

*Attorney, Agent, or Firm*—Panitch Schwarze Jacobs & Nadel

[57] ABSTRACT

A substance dispenser for dispensing substance onto an article is provided with a substance reservoir for storing substance and an openable closure element. The openable closure element forms one wall of the reservoir while closing the reservoir and permits passage of the article therethrough and into the reservoir. The article is also withdrawn from the reservoir after substance is dispensed to the inserted article by way of the openable closure element. The openable closure element opens when the article is urged against the closure element and sealingly closes around the article as the article is inserted into the reservoir and withdrawn from the substance reservoir. The sealing closure around the article as the article is withdrawn is effective to wipe excess substance from the article and to retain the excess substance within the reservoir. The openable closure element may be a resilient diaphragm having a slit. The reservoir may be provided with a frustum directing device to urge the substance toward the slit as the substance is advanced. The substance may be advanced rotatably or may be biased toward the closure element by a compression spring. A further reservoir, in fluid communication with the substance storage reservoir and containing a desiccant, may be provided for removing moisture from the substance reservoir.

19 Claims, 1 Drawing Sheet

SELF SEALING SUBSTANCE DISPENSER

This is a continuation of copending application Ser. No. 07/734,530 filed on Jul. 23, 1991, now abandoned.

BACKGROUND OF THE INVENTION (1) Field of The Invention

This invention relates to the field of substance dispensers and in particular to substance dispensers adapted to dispense substance onto an article inserted into the substance dispenser.

(2) Background Art

Many substance dispensers are known in the prior art for permitting a substance to be dispensed onto an article inserted into the dispenser. For example, in the field of dispensing dehorning paste it is well known to provide nozzle type dehorning chambers of varying configurations for receiving the horn of a calf. Dehorning paste stored in reservoirs within the dispensers is introduced into these dehorning chambers by way of feed ducts or tubes. When the horn of the calf is inserted and the dehorning paste is introduced into the dehorning chambers, the dehorning paste is applied to the horn within the dehorning chambers. The paste is advanced into the dehorning chambers through the feed ducts or tubes by means of manually operated plungers. Dehorning paste applicators of this type are taught in U.S. Pat. Nos. 2,388,321 and 2,433,947, issued to Gereke, on Nov. 9, 1945 and Jan. 6, 1948 respectively, U.S. Pat. No. 2,431,985, issued to Bowman, on Dec. 2, 1947, and U.S. Pat. No. 2,580,169, issued to Golden on Dec. 25, 1951.

One disadvantage of these devices is that the dehorning paste which is advanced from the storage reservoirs to the dehorning chamber is exposed to air and moisture in the air by way of the ducts connecting the dehorning chambers to the storage reservoirs. Thus, materials left in the storage reservoir may be degraded and these devices would not be suitable for storage of many materials. Furthermore, if excess substance is advanced through the feed ducts, the excess substance may fall from the container and be wasted or cause damage. Additionally, after dehorning paste is applied to a horn by these prior art devices and the horn is withdrawn, debris and excess dehorning paste deposited upon the horn may adhere to the horn and be removed from the dehorning chamber. This may result in waste and in injury if potentially harmful materials are spread to other areas.

It is also known in the prior art to provide substance dispensers for dispensing substance to an article wherein the substance is advanced by a plunger to an outlet which does not have a chamber or container for inserting the article therein. For example, U.S. Pat. No. 2,616,423, issued to Kurkjian, on Nov. 4, 1952, and U.S. Pat. No. 2,924,219, issued to Wershaw on Feb. 9, 1960, teach such devices. The devices of Kurkjian and Wershaw teach advancing the substance being dispensed to the end of a cylindrical storage reservoir and permitting contact between the substance being dispensed and the article by way of a wide mouth opening. However, substance dispensers of this type are suitable only for relatively solid substances. Liquid, paste, and powdered substances are not satisfactorily contained when advanced by the plungers of these devices because the wide mouth openings of these devices permit these substances to leak from the cylindrical storage reservoir.

Additionally, the devices of Kurkjian and Wershaw are not suitable for dispensing substance to articles which are subject to unpreventable and unpredictable movement. If such an article is inserted into the wide mouth openings of these devices, and movement occurs, solid substance close to the mouth of the devices may be disrupted. Furthermore, during withdrawal of an article from the devices of Kurkjian and Wershaw there is not provided any means for removing excess substance from an article inserted through the opening in order to apply substance to the article.

U.S. Pat. No. 4,747,842, issued to Dietz on May 31, 1988, also teaches a substance dispenser into which an article may be disposed for dispensing the substance from the dispenser onto the article. The substance dispenser of Dietz includes an open reservoir having a cylindrical portion and a frustum shaped depression below the cylindrical portion. An article may be inserted into the reservoir to dispense substance onto the article and the article may then be removed. However, excess substance dispensed onto the article may remain attached to the inserted article and may cause damage to the article, to other items, or to users of the device. Additionally, the open reservoir of Dietz permits the substance contained within the reservoir to spill out when inverted. The open reservoir also exposes the substance to moisture and bacteria. This may cause the substance to lump or degrade and may cause infection.

U.S. Pat. No. 4,282,891, issued to Duceppe, on Aug. 11, 1981, and U.S. Pat. No. 4,530,726, issued to Motiel, on Jul. 23, 1985, teach substance dispensers having a sponge which is saturated with a substance to be dispensed. The sponge is provided with slits to permit the insertion of an article, such as a finger, into the slits in order to thereby permit the substance to be dispensed from the sponge onto the inserted article. Thus these devices are not effective to permit the article to be inserted into a reservoir of substance for dispensing substance from the reservoir onto the article. The slits in the sponges taught by Duceppe and Motiel wipe excess substance from the article to which the substance is dispensed as the article is withdrawn. However, these substance dispensers are adapted only for dispensing and removing excess liquid materials from an article. These dispensers are not suitable for dispensing solid or powdered substance.

Therefore, it is an object of the invention to permit dispensing of the substance onto an article inserted in the dispenser and to conveniently replenish the supply of substance in the area into which the article is inserted and the substance is dispensed.

It is a further object of the invention to provide a substance dispenser which removes excess substance from the article as the article is withdrawn from the dispenser.

It is a further object of the invention to permit the dispenser to be inverted without the substance spilling from the dispenser.

It is a still further object of the invention to provide a substance dispenser which dispenses substance to articles which may move with respect to the dispenser.

SUMMARY OF THE INVENTION

A substance dispenser for dispensing substance onto an article is provided with a storage reservoir for storing substance and an openable closure element. The openable closure element forms one wall of the reservoir, permitting passage of the article therethrough and into the reservoir. The inserted article is withdrawn from the reservoir after substance is dispensed onto it by way of the openable closure element. The openable closure element opens when the article is urged against the closure element and sealingly closes around the article as the article is inserted into the reservoir and withdrawn from the reservoir. The sealing closure around the article as the article is withdrawn is effective to wipe excess substance from the article and to retain the excess substance within the reservoir.

DETAILED DESCRIPTION OF THE INVENTION

Figure 2:
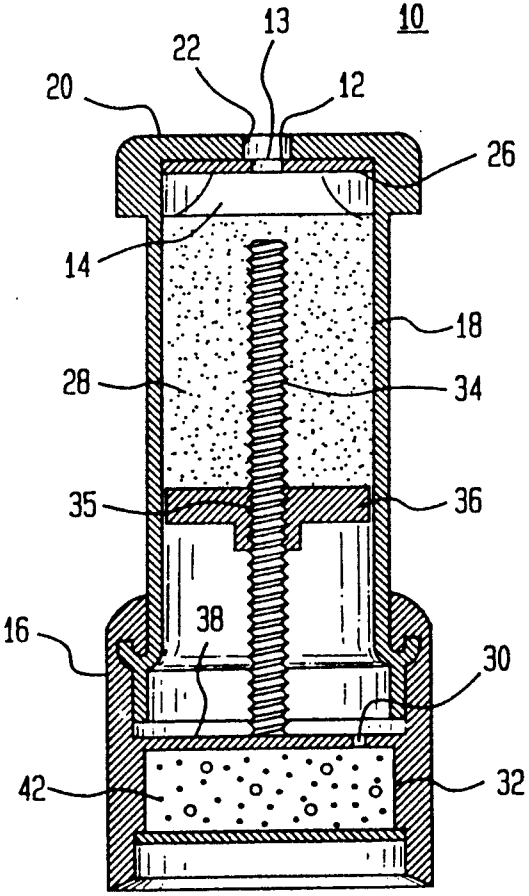
FIG. 2 shows a cross-sectional representation of the substance dispenser of FIG. 1.
Figure 1:
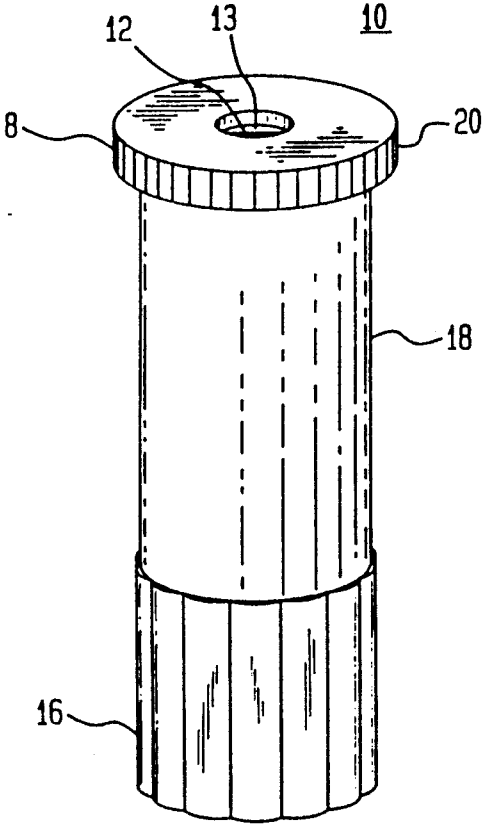
FIG. 1 shows a perspective view of the substance dispenser of the present invention.

Referring now to FIGS. 1, 2, there is shown self-sealing substance dispenser 10 of the present invention. Self-sealing substance dispenser 10 is provided with substance reservoir chamber 18 for containing dispensable substance 28 and advancing dispensable substance 28 through substance reservoir chamber 18. Substance 28, advanced through substance reservoir chamber 18 to dispensing opening 22, is dispensed by self-sealing substance dispenser 10 to insertable article 11 which is inserted into substance dispenser 10 to receive substance 28. After receiving substance 28, insertable article 11 is withdrawn from self-sealing substance dispenser 10 by way of dispensing opening 22.

Substance 28 is advanced through substance reservoir chamber 18 of self-sealing substance dispenser 10 as it is dispensed by means of advancing elevator screw 34. Advancing elevator screw 34 is rotated by means of fluted rotating lower tubular portion 16 in order to rotatably advance substance platform 36. As substance platform 36 or reservoir plunger 36 is advanced through substance reservoir chamber 18, substance platform 36 forces substance 28 toward dispensing opening 22 at the top of self-sealing substance dispenser 10. As substance 28 is dispensed to insertable article 11 by way of dispensing opening 22, further substance 28 is thus advanced from substance reservoir chamber 18 to the vicinity of dispensing opening 22 to replenish the supply of substance 28 available to be dispensed.

In order to assist in forcing substance 28 toward opening 22, self-sealing substance dispenser 10 of the present invention is provided with frustum shaped directional device 14 or substance centering device 14 at the top of reservoir chamber 18. Frustum shaped directional device 14 is disposed between substance 28 contained within reservoir chamber 18 and dispensing opening 22 in order to force transported substance 28 toward the center of top cap 20 of substance dispenser 10. The centering of substance 28 at the top of self-sealing substance dispenser 10 causes substance 28 to be delivered to the vicinity of dispensing opening 22 where it may be easily dispensed.

Plastic diaphragm 12 is disposed between dispenser cap 20 and directional device 14. In order to provide openable self-sealing closure of substance reservoir chamber 18 within substance dispenser 10, plastic diaphragm 12 is provided with resiliently self-sealing opening 13 or self-sealing slit 13. In an alternate embodiment (not shown) self-sealing opening 13 may be formed as two or more slits or openings which intersect each other at varying angles. Right angle intersection is believed to be advantageous. It will be understood by those skilled in the art that plastic diaphragm 12 may be affixed to the inside of dispenser cap 20 or in any other suitable manner positioned for closure of substance reservoir chamber 18. In addition to being positioned for closure of substance reservoir chamber 18, diaphragm 12 must be positioned such that substance 28, transported through reservoir chamber 18 and directed by directional device 14, is delivered to the vicinity of self-sealing opening 13 to be dispensed from substance dispenser 10 by way of self-sealing opening 13.

As previously described, closeable opening 13 is resiliently closeable. However, it will be understood that resiliently closeable opening 13 is also resiliently openable when insertable article 11 is urged against it. It will be further understood that forming diaphragm 12 of a thin layer of plastic or rubber is effective to permit diaphragm 12 to be openable by urging insertable article 11 against opening 12 and to be sealingly closable around inserted article 11. It will also be understood that diaphragm 12 may be formed of any material which permits it to be resiliently openable and self-sealing as required to perform the functions as described for plastic diaphragm 12 or rubber diaphragm 12.

Thin rigid plastic washer 26 may be inserted between frustum shaped directional device 14 and plastic diaphragm 12. Plastic washer 26 is provided within self-sealing substance dispenser 10 to prevent distortion, buckling and twisting of diaphragm 12 as plunger 36 or piston 36 is rotatably advanced through substance reservoir chamber 18 of substance dispenser 10.

In the preferred embodiment of self-sealing substance dispenser 10, secondary storage chamber 32 may be provided below screw disk 38 of fluted rotating lower tubular portion 16. Opening 30 through screw disk 38 permits fluid communication between substance reservoir chamber 18 and secondary storage chamber 32. Secondary chamber 32 may contain further substance 42. Further substance 42 may be, for example, a desiccant for removing moisture from dispensable substance 28 within reservoir chamber 18 by way of opening 30.

Screw elevator 34 may be rotated by manual rotating of fluted rotating lower tubular portion 16 at the bottom of self-sealing substance dispenser 10. However, it will be understood by those skilled in the art that methods other than rotatable advancement of substance 28 may be used within self-sealing substance dispenser 10. As previously described, in this rotatable method of advancing substance 28, relative rotational motion between substance advancing platform 36 and elevator screw 34 attached to lower tubular portion 16 causes platform 36 to be advanced through tubular reservoir chamber 18.

This movement of platform 36 when screw elevator 34 is rotated is caused by the cooperation of threads 35 on platform 36 and threads provided on screw elevator 34. When the threads of threaded platform 36 are threadably mated with the threads elevator screw 34, platform 36 is advanced because of this cooperative engagement. Platform 36 elevates substance 28 contained within chamber 18 as it rises. Substance 28 is directed through frustum shaped directional device 14 at the top of self-sealing substance dispenser 10 and stops when it comes into compressed contact with plastic diaphragm 12.

Figure 3:
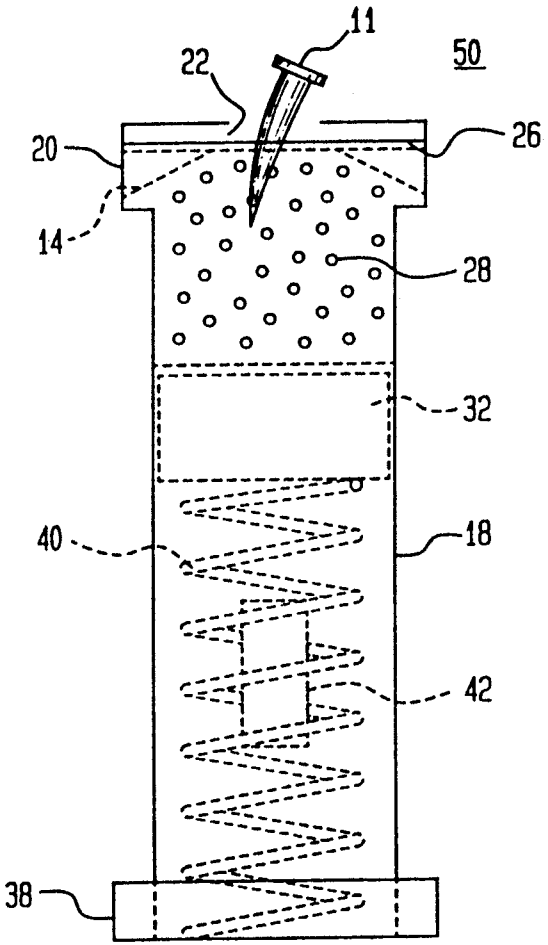
FIG. 3 shows a cross-sectional representation of an alternate embodiment of the substance dispenser of FIG. 1.

Referring now to FIG. 3, there is shown self-sealing substance dispenser 50. Self-sealing substance dispenser 50 is an alternate embodiment of self-sealing substance dispenser 10 which is provided with an alternate method of advancing substance 28. Plastic diaphragm 12 of substance dispenser 50 is provided with self-sealing opening 13 or slit 13 as previously described. Additionally, plastic diaphragm 12 is provided with retaining washer 26 and centering funnel 14.

Within substance dispenser 50 of the present invention, substance advancing piston 32 is advanced by the force of compression spring 40 within tubular reservoir housing 18. As substance 28 is dispensed from reservoir chamber 18 through self-sealing opening 13, more substance 28 is centered and transported to self-sealing opening 13 by centering device 14 due to the action of compression spring 40 as compression spring 40 advances substance advancing piston 32 or plunger 32. Substance 28 is prevented from becoming disposed between piston 32 and the inner surface of substance reservoir chamber 18 by substance retainer washer 30. Further substance 42 may be dispoed within substance reservoir chamber 18 of dispenser 50. Further substance 42 may be a dessicant ampule.

While self-sealing substance dispenser 10 and self-sealing substance dispenser 50 are shown having cylindrical substance reservoir chambers 18, it will be understood by those skilled in the art that any shape of substance reservoir chamber 18 may be used without departing from the spirit of the invention. Furthermore, in addition to rotatable advancement of rotatably advancing platform 36 or plunger 36 and compression advancement of substance advancing piston 32, any other means of advancing substance 28 to self-sealing opening 13 through resilient diaphragm 12 for the dispensing of substance 28 from substance dispensers 10, 50 may be used.

Substance 28 within substance dispensers 10, 50 may most advantageously be a powdered substance 28 such as styptic powder 28 for stopping small amounts of bleeding. Insertable article 11, inserted through self-sealing opening 13 of diaphragm 12, may be a part of an animal, for example, a nail 11 of a dog (not shown). In this use of self-sealing substance dispensers 10, 50, nail 11 which has been freshly trimmed and is bleeding may be inserted through self-sealing opening 13 into substance reservoir chamber 18 containing styptic powder. This causes styptic powder 2 to be disposed upon inserted nail 11. As nail 11 is being inserted and withdrawn through self-sealing opening 13, self-sealing opening 13 resiliently and sealingly closes around nail 11. This prevents inadvertent spilling of styptic powder 28 during dispensing of styptic powder to nail 11. Additionally, as nail 11 is withdrawn through self-sealing opening 13, self-sealing opening 13 closes behind nail 11 and wipes excess styptic powder 28 from nail 11. It will be understood that dispensers 10, 50 may be advantageously applied to the beak of a bird, the tail of a dog, or any other similarly shaped animal part.

If the dog moves suddenly, causing movement of the nail within opening 22 of substance dispenser 10, no harm is caused to the dog or to substance dispenser 10 because plastic diaphragm 12 deforms to accommodate the motion. If the movement of the dog is extreme enough to overturn or invert self-sealing substance dispenser 10, styptic powder 28 or substance 28 does not leak from substance dispenser 10 since opening 13 sealingly closes around nail 11 when nail 11 is inserted or withdrawn.

If the dog suddenly removes nail 11 from substance dispenser 10, the dog is not injured, soiled or stained due to excess amounts of styptic powder 28 adhering to nail 11 being transferred to other areas of the body or eyes of the dog, because the excess is removed during withdrawal of nail 11 by the self-sealing closure of opening 13 around nail 11. Furthermore, the removal of the excess styptic powder 28 adhering to nail 11 by the sealing closure of opening 13 around nail 11 also protects the user of self-sealing substance dispensers 10, 50 because excess styptic power 28 is removed during the withdrawal of nail 11 prior to any excess being transferred to the hands or clothing. During extreme movement of the dog, substance 28 could even get into the eyes of the user unless the excess is removed. Additionally, because opening 13 automatically closes behind nail 11 when nail 11 is withdrawn, styptic powder 28 is protected against spillage, moisture, and bacteria.

It will be understood that various changes in the details, materials, and arrangement of the parts which have been described and illustrated in order to explain the nature or this invention, may be made by those skilled in the art without departing from the principle and scope of the invention as expressed in the following claims.

I claim:

1. A substance dispenser for dispensing substance to an article, comprising:

first and second reservoir means for storing substance;

a powdered substance;

openable closure means for closing said first reservoir means and containing said powdered substance within said first reservoir means;

said openable closure means having opening means for opening to permit passage of said article through said openable closure means and into said first reservoir means for dispensing said powdered substance to said article; and, stationary directing means rigidly coupled to said first reservoir means for directing said powdered substance within said first reservoir means toward said opening of said openable closure means.

2. The substance dispenser of claim 1, wherein said openable closure means comprises a diaphragm.

3. The substance dispenser of claim 1, wherein said opening means comprises a self-closing opening through said openable closure means adapted to open and permit said passage of said article through said openable closure means in response to urging said article against said self-closing opening.

4. The substance dispenser of claim 3, wherein said self-closing opening of said openable closure means comprises a slit opening for permitting said passage of said article therethrough.

5. The substance dispenser of claim 1, wherein said openable closure means is adapted to close upon said article as said article is withdrawn to remove excess substance from said article.

6. The substance dispenser of claim 5, wherein said openable closure means is formed of a resilient material for resiliently closing upon said article as said article is withdrawn.

7. The substance dispenser of claim 1, wherein said openable closure means closes behind said article after said article is withdrawn from said dispenser to prevent passage of said stored substance through said openable closure means.

8. The substance dispenser of claim 1, wherein said openable closure means is adapted to sealingly close around said article during said passage of said article through said openable closure means.

9. The substance dispenser of claim 1, wherein said directing means is formed separately from an inner wall of said first reservoir means.

10. The substance dispenser of claim 1, further comprising rotatable advancement means for rotatably advancing said substance toward said openable closure means.

11. The substance dispenser of claim 1, further comprising compression advancement means for biasing said substance toward said openable closure means.

12. The substance dispenser of claim 1, wherein said second reservoir means is in communication with said first reservoir means.

13. The substance dispenser of claim 12, wherein there is further provided a dessicant for absorbing moisture from said first reservoir means.

14. The substance container of claim 1, wherein said powdered substance is styptic powder.

15. The substance dispenser of claim 14, wherein said openable closure means comprises means for permitting passage of a part of an animal.

16. The substance dispenser of claim 15, wherein said part is the nail of an animal.

17. The substance dispenser of claim 15, wherein said part is the beak of a bird.

18. The substance dispenser of claim 1, wherein said directing means is substantially cylindrical.

19. The substance dispenser of claim 18, wherein the diameter of said cylindrical directing means decreases in the direction toward said opening.

* * * * *